US007402054B2

(12) United States Patent
Peng et al.

(10) Patent No.: US 7,402,054 B2
(45) Date of Patent: Jul. 22, 2008

(54) BOARD-TO-BOARD CONNECTOR

(75) Inventors: Yung-Chi Peng, Taipei Hsien (TW); Hsin-Ta Chen, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/563,318

(22) Filed: Nov. 27, 2006

(65) Prior Publication Data

US 2008/0124977 A1 May 29, 2008

(51) Int. Cl.
*H01R 12/00* (2006.01)

(52) U.S. Cl. ..... 439/74

(58) Field of Classification Search ..... 439/74, 439/357, 571, 570, 79, 81, 660
See application file for complete search history.

(56) References Cited

U.S. PATENT DOCUMENTS 5,545,051 A * 8/1996 Summers et al. ..... 439/350
5,876,217 A 3/1999 Ito et al.
6,554,637 B1 * 4/2003 Yu ..... 439/489
6,811,411 B1 * 11/2004 Hirata et al. ..... 439/74
7,070,423 B2 * 7/2006 Zhang et al. ..... 439/74
7,090,508 B1 * 8/2006 Chen ..... 439/74

* cited by examiner

*Primary Examiner*—Alexander Gilman
(74) *Attorney, Agent, or Firm*—WPAT, P.C.; Anthony King

(57) ABSTRACT

The board-to-board connector comprises an insulating housing and a plurality of terminals. The terminals are mounted in corresponding terminal-receiving passages which are arranged in the insulating housing. The insulating housing has a base plate. A pair of first sidewalls protrudes upwards from the opposite longwise sides of the base plate. A pair of second sidewalls protrudes upwards from another opposite sides of the base plate. The central island portion keeps a certain distance to the first sidewalls and the second sidewalls, thus a periphery-receiving place is formed between the central island portion and sidewalls. Fixing parts are formed on the inside wall of the first sidewall exposed in the periphery-receiving place.

3 Claims, 4 Drawing Sheets

BOARD-TO-BOARD CONNECTOR

BACKGROUND OF THE INVENTION

1. Field of the Invention

The present invention relates to a board-to-board connector, and particularly, to a board-to-board connector with an improved locking mechanism for firming up a plug.

2. The Related Art

A variety of electronic connectors have been used to make electrical connections between the circuits on different printed circuit boards. These printed circuit boards must be joined together with connectors in a manner to effectively and reliably interconnect the circuits on one printed circuit board to the circuits of another printed circuit board, in order to establish signal communication or power connection.

U.S. Pat. No. 5,876,217, issued Mar. 2, 1999, the disclosure which is hereby incorporated by reference in its entirety, discloses a connector system and method for connecting cooperating printed circuit boards and transferring high frequency radio frequency signals between the printed circuit boards. The connector assembly includes opposing plug and receptacle connector housings, each containing conductive terminals. The terminals of one of the connector housings, preferably the plug connector housing include body portion with separate contact and locking portions extending upwardly therefore and spaced apart from each other define a nest there between. The nest receives a portion of the other connector engage opposing sides of the other connector-housing portion. The contact portions fictionally engage the other connector-housing terminal while the locking portions positively engage recesses formed in the other connector housing.

When the connector mated, as designed above, the receptacle lacks for corresponding fixing portion to firm up the plug, thus the plug will not be firmed effectively when the plug inserted into the receptacle, and then the conductive terminals of the plug will not achieve reliable electronic contact with corresponding receptacle.

SUMMARY OF THE INVENTION

The present invention has been achieved in view of the above insufficiencies to provide a board-to-board connector with stable structure to firm up a plug.

An objective of the present invention is to provide a board-to-board connector which comprises a insulating housing and a plurality of terminals accommodated in the insulating housing. The terminals are mounted in corresponding terminal-receiving passages arranged in the insulating housing. The insulating housing has a base plate. A pair of first sidewalls protrudes upwards from the opposite longwise sides of the base plate. Further more, a pair of second sidewalls protrudes upwards from another opposite sides of the base plate. A central island portion protrudes upwards from the center of the base plate. The central island portion keeps a certain distance to the first sidewalls and the second sidewalls, thus a periphery-receiving place is formed between the central island portion and sidewalls. Fixing parts are formed on the inside wall of the first sidewall exposed in the periphery-receiving place.

When the connector mated with plug, the fixing part presses on the sidewalls of the plug. As a result, the periphery-receiving place snugly fits the plug and establishes a firm connection therebetween.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
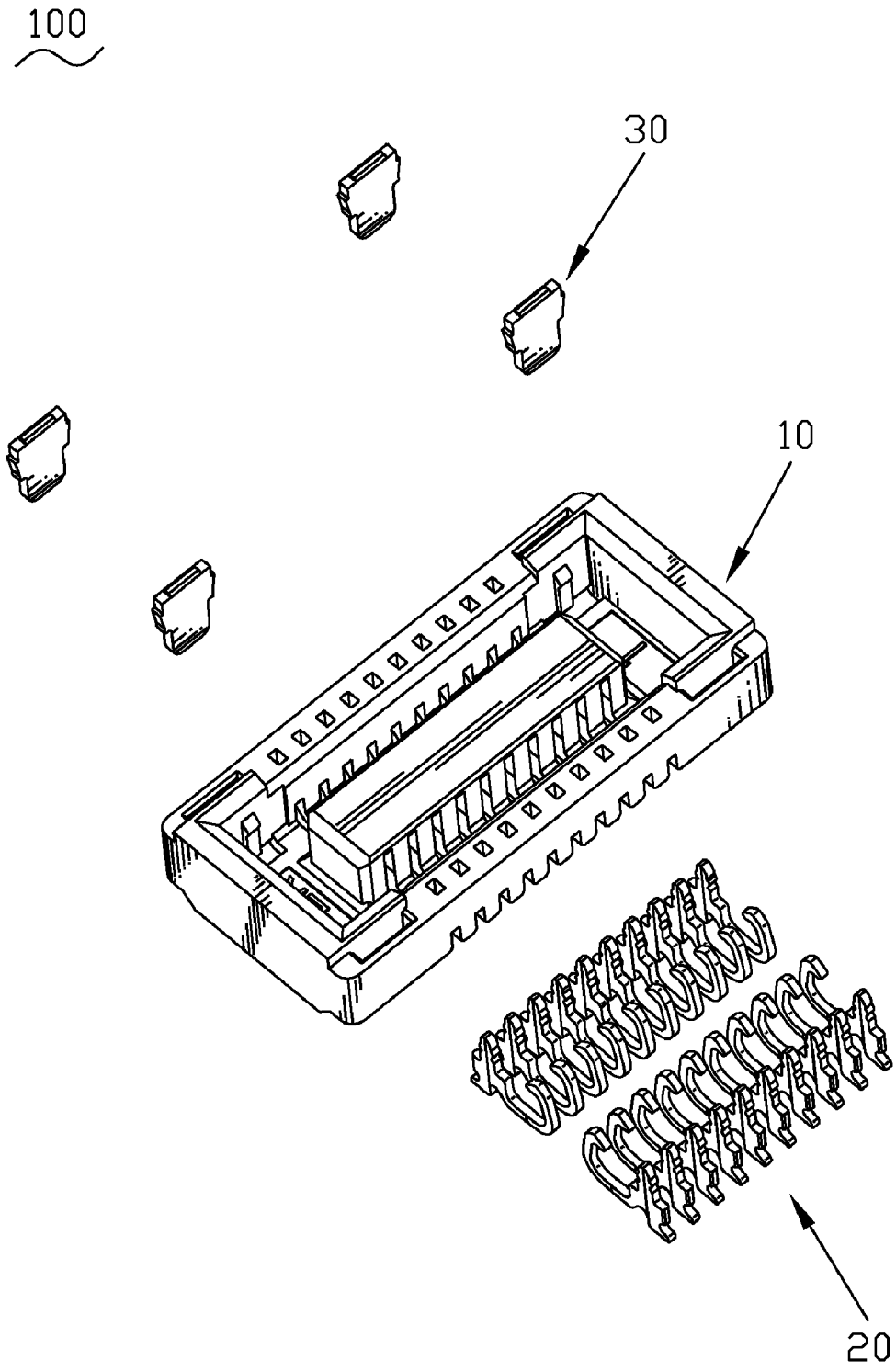
FIG. 1 is an exploded view of a board-to-board connector.
Figure 2:
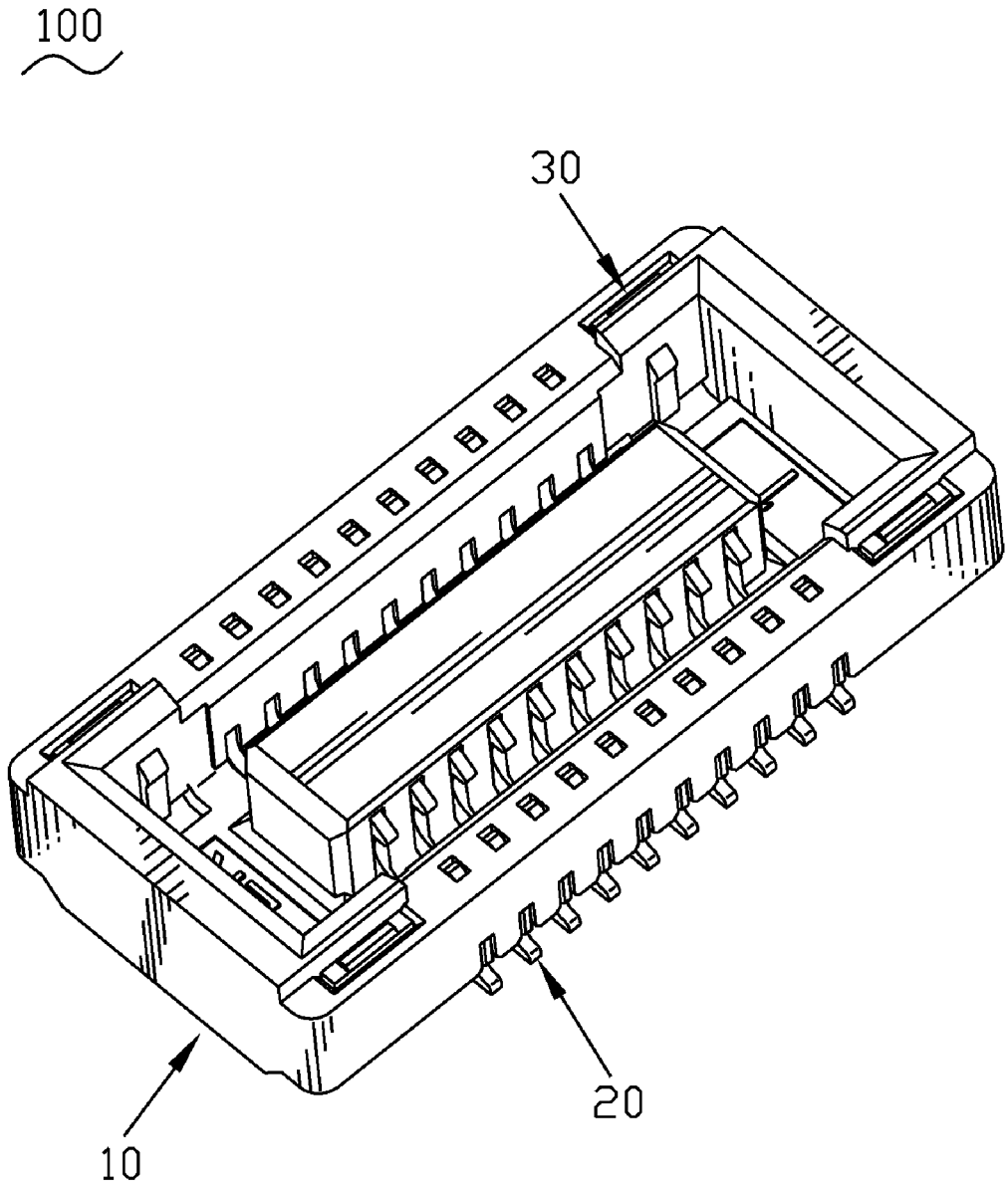
FIG. 2 is a perspective view of a board-to-board connector.

With reference to FIG. 1 and FIG. 2, a board-to-board connector 100 according to the present invention is illustrated. The board-to-board connector 100 includes an insulating housing 10, a plurality of terminals 20 and fitting nails 30 accommodated in the insulating housing 10.

Figure 3:
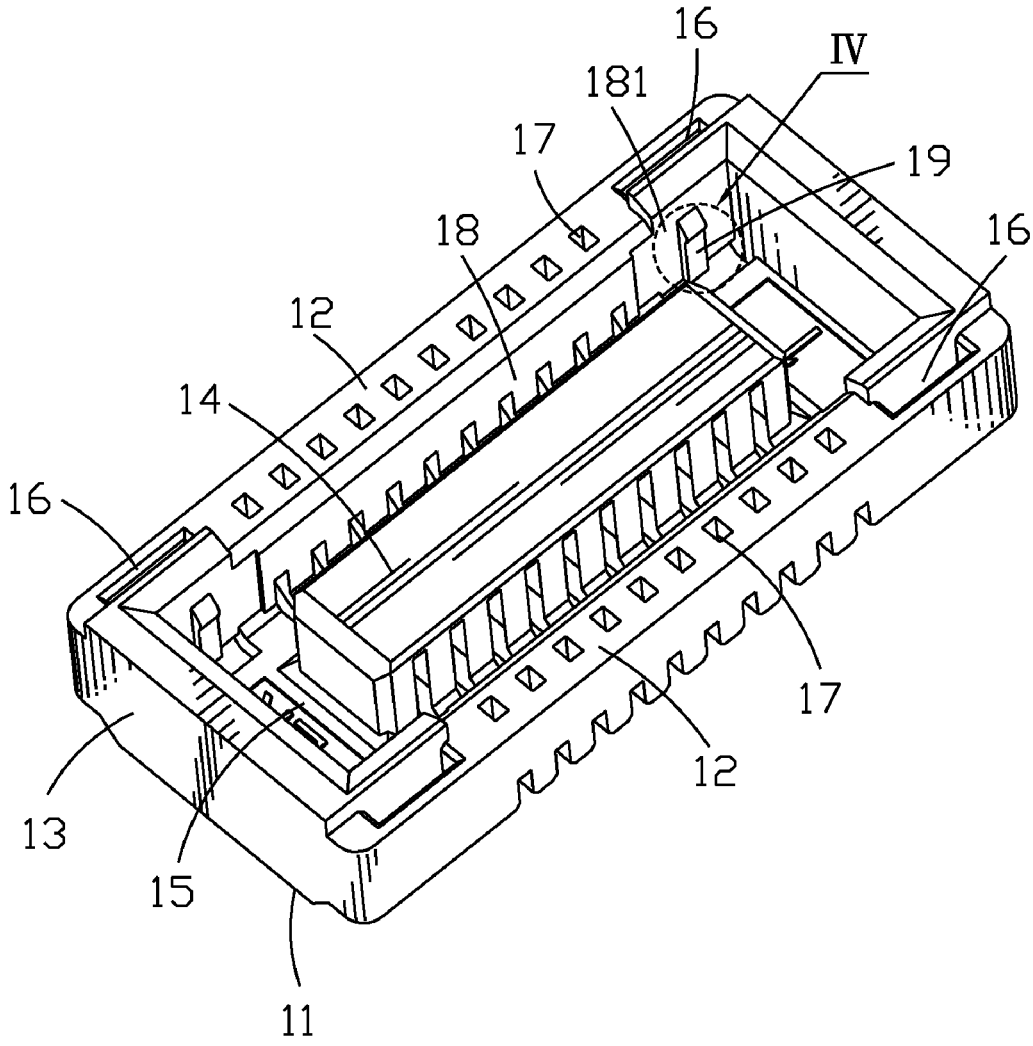
FIG. 3 is a perspective view of an insulating housing of the board-to-board connector.

In conjunction with FIG. 3, the insulating housing 10 is rectangle shaped and has a flat base plate 11. A pair of first sidewalls 12 protrudes upwards from the opposite longwise sides of the base plate 11. Further more, a pair of second sidewalls 13 protrudes upwards from another opposite sides of the base plate 11. A central island portion 14 protrudes upwards from the center of the base plate 11. The central island portion 14 keeps a certain distance to the first sidewalls 12 and the second sidewalls 13, thus a periphery-receiving place 15 is formed between the central island portion 14 and sidewalls 12, 13. A plurality of fitting nail grooves 16 defined in the second sidewalls 13 perforates through the second sidewalls 13. The conductive terminals 20 are accommodated in the corresponding terminal-receiving passages 17 which arranged in the insulating housing 10. The fitting nails 30 are accommodated in the corresponding fitting nail grooves 16, moreover the fitting nails 30 are welded to an external printed circuit board, thus the board-to-board connector 100 is firmed on the printed circuit board.

Figure 4:
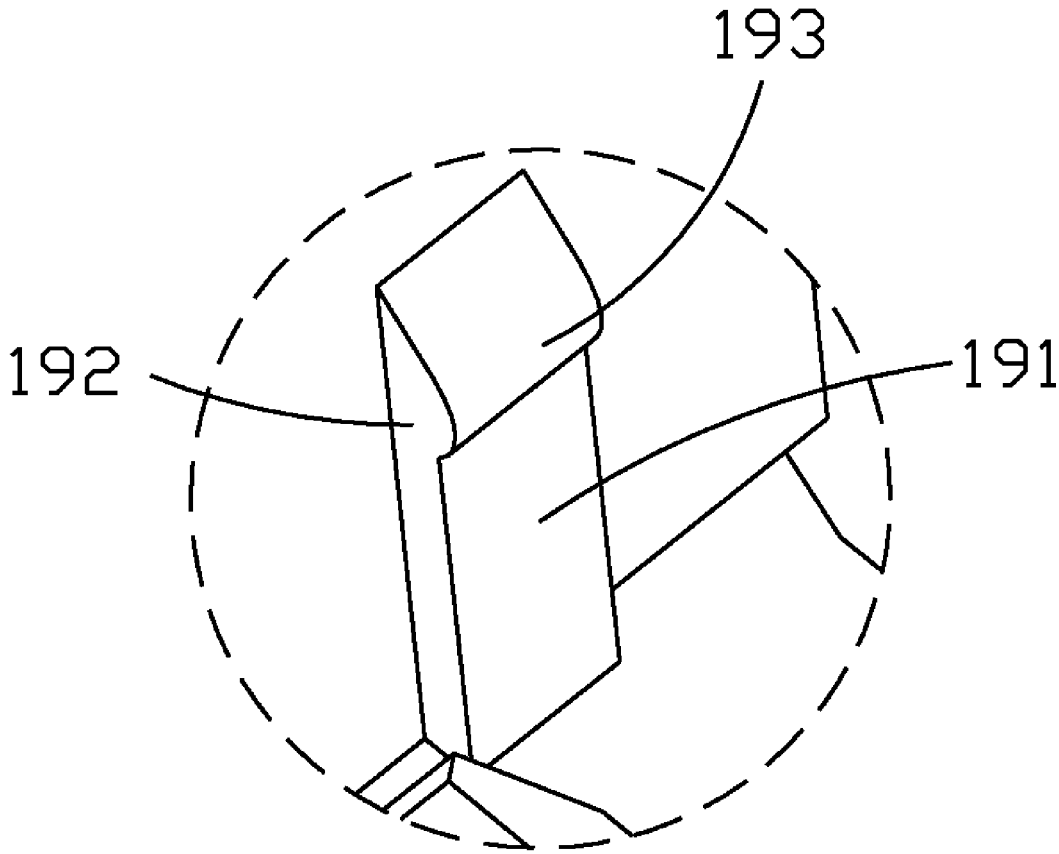
FIG. 4 is a partial enlargement view of FIG. 3 as indicated by arrow IV.

With reference to FIG. 3 and in conjunction with FIG. 4, the inside wall of the first sidewall 12 consists of a rectangular interior 18 and a concave 181 formed in the interior 18. The interior 18 projects from inside wall of the first sidewall 12, and the concave 181 located at the end of the interior 18. Each concave 181 of the first sidewall 12 defines a fixing part 19 exposed in the periphery-receiving place 15. The fixing part 19 further includes a base part 191 that mounts on the concave 181 and a convex 192 connecting with the base part 191. The convex 192 has a smooth exterior 193.

When the board-to-board connector 100 mated with a plug (not shown), the plug is inserted into the periphery-receiving place 15. The fixing part 19 presses on the sidewalls of the plug. As a result, the periphery-receiving place 15 snugly fits the plug and establishes a firm connection therebetween.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A board-to-board connector, comprising:

an insulating housing having a base plate, a pair of first sidewalls protruding upwards from opposite longwise sides of the base plate, a pair of second sidewalls protruding upwards from another opposite sides of the base plate, a central island portion protruding upwards from a center of the base plate, the central island portion keeping a certain distance to the first sidewalls and the second sidewalls for forming a periphery-receiving place between the central island portion and the first and second sidewalls, a fixing part formed as an integral part on an inside wall of the first sidewall exposed in the periphery-receiving place; and a plurality of terminals accommodated in the insulating housing, the terminals mounted in corresponding terminal-receiving passages arranged in the insulating housing, wherein the inside wall of the first sidewall has an interior wall section formed in a middle part of the first sidewall, and a concave section formed at the end of the interior wall section, wherein the concave sections of the first side wall are thinner than the interior wall section of the first side wall, and the fixing part is formed on the concave; and wherein the fixing part is a rectangular block with a longitudinal axis perpendicular with a longitudinal axis of the first side wall, the fixing part has a tapered arrow head with a smooth hook, and wherein the taper arrow head points upwards.

2. The board-to-board connector as claimed in claim 1, wherein the fixing part includes a base part that mounts on the concave section of the interior wall section and a convex arrow head connecting with the base part, the convex further having a smooth exterior.

3. The board-to-board connector as claimed in claim 1, further comprising a plurality of fitting nails accommodated in the insulating housing.

* * * * *